US010143303B2

(12) United States Patent
Koenig et al.

(10) Patent No.: US 10,143,303 B2
(45) Date of Patent: Dec. 4, 2018

(54) DRIVE MECHANISM FOR A MOVABLE FURNITURE PART

(71) Applicant: Julius Blum GmbH, Hoechst (AT)

(72) Inventors: Bernd Koenig, Hoechst (AT); Marc Meusburger, Egg (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 15/380,368

(22) Filed: Dec. 15, 2016

(65) Prior Publication Data

US 2017/0095084 A1 Apr. 6, 2017

Related U.S. Application Data

(63) Continuation of application No. PCT/AT2015/000062, filed on May 4, 2015.

(30) Foreign Application Priority Data

Jun. 16, 2014 (AT) ..... A 475/2014

(51) Int. Cl.
*A47B 88/463* (2017.01)
*E05F 1/16* (2006.01)
(Continued)

(52) U.S. Cl.
CPC ..... *A47B 88/463* (2017.01); *A47B 88/45* (2017.01); *A47B 88/467* (2017.01);
(Continued)

(58) Field of Classification Search
CPC .... A47B 2210/0078; A47B 2210/0083; A47B 88/463; A47B 88/473; A47B 88/467; A47B 88/483; A47B 88/45
See application file for complete search history.

(56) References Cited

U.S. PATENT DOCUMENTS 8,356,864 B2 1/2013 Koenig et al.
8,534,781 B2 9/2013 Netzer et al.
(Continued)

FOREIGN PATENT DOCUMENTS

AT 507 656 7/2010
AT 514865 4/2015
(Continued)

OTHER PUBLICATIONS

International Search Report dated Sep. 22, 2015 in International (PCT) Application No. PCT/AT2015/000062.
(Continued)

*Primary Examiner* — Hanh V Tran
(74) *Attorney, Agent, or Firm* — Wenderoth, Lind & Ponack, L.L.P.

(57) ABSTRACT

A drive mechanism for a movable furniture part, in particular a drawer, has a first and a second lockable pushing-out mechanism and a synchronizing mechanism for synchronizing the two pushing-out mechanisms. The synchronizing mechanism has a synchronizing rod and a first and a second synchronizing element which can be connected to the synchronizing rod, and relative movement takes place between the synchronizing elements and the pushing-out mechanisms during synchronizing operation. In an active synchronizing mode, during synchronizing operation, movement is transmitted from the first pushing-out mechanism, via the first synchronizing element, the synchronizing rod and the second synchronizing element, to the second pushing-out mechanism. In an inactive synchronizing mode, the synchronizing rod is removed and the synchronizing elements each remain in contact with one of the pushing-out mechanisms.

20 Claims, 13 Drawing Sheets

(51) Int. Cl.

| | |
|---|---|
| ***A47B 88/473*** | (2017.01) |
| ***A47B 88/467*** | (2017.01) |
| ***A47B 88/483*** | (2017.01) |
| ***A47B 88/45*** | (2017.01) |

(52) U.S. Cl.

CPC ..... *A47B 88/473* (2017.01); *A47B 88/483* (2017.01); *E05F 1/16* (2013.01); *A47B 2210/0078* (2013.01); *A47B 2210/0083* (2013.01); *E05Y 2201/62* (2013.01); *E05Y 2800/21* (2013.01)

(56) References Cited

U.S. PATENT DOCUMENTS

| | | | | |
|---|---|---|---|---|
| 8,567,884 | B2 | 10/2013 | Isele et al. | |
| 8,668,286 | B2 | 3/2014 | Gasser | |
| 8,950,833 | B2 | 2/2015 | Bohle | |
| 9,085,925 | B2 | 7/2015 | Steinhauser | |
| 9,109,649 | B2 | 8/2015 | Bohle | |
| 2008/0036345 | A1* | 2/2008 | Kropf | E05B 65/46 312/333 |
| 2008/0054771 | A1* | 3/2008 | Brunnmayr | E05D 3/14 312/323 |
| 2009/0261698 | A1* | 10/2009 | Cabal Velarde | A47B 88/43 312/334.8 |
| 2010/0219727 | A1* | 9/2010 | Aguilar Ante | A47B 88/40 312/319.1 |
| 2010/0314981 | A1 | 12/2010 | Koenig et al. | |
| 2011/0037362 | A1* | 2/2011 | Park | A47B 88/467 312/319.1 |
| 2012/0038255 | A1 | 2/2012 | Netzer et al. | |
| 2012/0091872 | A1* | 4/2012 | Matthes | A47B 88/40 312/334.8 |
| 2012/0181909 | A1 | 7/2012 | Isele et al. | |
| 2012/0237144 | A1 | 9/2012 | Gasser | |
| 2012/0243810 | A1* | 9/2012 | Schwartzmann | A47B 88/49 384/20 |
| 2013/0129266 | A1* | 5/2013 | Chen | A47B 88/40 384/20 |
| 2013/0307390 | A1* | 11/2013 | Bohle | E05D 15/463 312/294 |
| 2013/0334946 | A1 | 12/2013 | Netzer et al. | |
| 2014/0060991 | A1 | 3/2014 | Bohle | |
| 2014/0191632 | A1 | 6/2014 | Steinhauser | |
| 2014/0300262 | A1 | 10/2014 | Flogaus | |
| 2016/0206093 | A1 | 7/2016 | Brunnmayr et al. | |

FOREIGN PATENT DOCUMENTS

| | | |
|---|---|---|
| CN | 102413733 | 4/2012 |
| CN | 103338680 | 10/2013 |
| CN | 103547191 | 1/2014 |
| DE | 20 2012 002 378 | 8/2013 |
| EP | 2 429 339 | 3/2012 |
| EP | 2 515 710 | 10/2012 |
| JP | 2012-526565 | 11/2012 |
| JP | 2014-503321 | 2/2014 |
| WO | 2009/114886 | 9/2009 |
| WO | 2011/047396 | 4/2011 |
| WO | 2012/159136 | 11/2012 |
| WO | 2013/040611 | 3/2013 |
| WO | 2013/096981 | 7/2013 |

OTHER PUBLICATIONS

Search Report dated Mar. 30, 2015 in Austrian Application No. A 475/2014, with English translation.

Search Report dated May 3, 2018 in Chinese Patent Application No. 201580031999.9.

* cited by examiner

50

S1

S1

SO

VS

S1

DRIVE MECHANISM FOR A MOVABLE FURNITURE PART

BACKGROUND OF THE INVENTION

The invention concerns a drive device for a movable furniture part, in particular a drawer, comprising a first and a second lockable ejection device and a synchronizing device for synchronizing the two ejection devices. The synchronizing device comprises a synchronizing rod and a first and second synchronizing element, which can be connected to the synchronizing rod, and a relative movement takes place between the synchronizing elements and the ejection devices during the synchronizing operation. Moreover, the invention concerns an item of furniture comprising a furniture carcass and furniture part movably supported on the furniture carcass and such a drive device.

Generally in the furniture sector, numerous applications are already known with which a synchronizing operation takes place mostly due to the reason to uniformly move the movable furniture part and to not allow a crooked position.

Examples of non-generic synchronizing operations with furniture flaps are known from WO 2011/047396 A1 and WO 2013/040611 A1. Accordingly, actuating devices of flap fittings are synchronized by synchronizing devices. In these cases, each movement of the actuating devices is always transmitted to the other actuating device via the synchronizing rod. No relative movement occurs between the synchronizing rods and the actuating drives during the synchronizing operation. In the latter document, indeed, a so-called touch-latch device for ejecting movable furniture parts is mentioned. However, the movement of the entire actuating devices are always synchronized via the synchronization rods shown in this document and these touch-latch devices are not directly synchronized. Rather, each synchronizing rod is stationarily connected with a corresponding arm of each actuating device. No relative movement takes place between the synchronizing rod and this arm of the respective actuating device.

Further, synchronizing devices are also known with non-generic side stabilizing mechanisms, and an example of this type is EP 2 515 710 B1. These side stabilizing mechanisms serve to synchronize the movements of the drawer rails per se. In this non-generic document, there is no ejection device of any kind whatsoever. A similar device for side stabilization is known from the WO 2012/159136 A1. Herein, it is especially about an overload safety device arranged between shaft parts of a synchronizing rod.

In contrast, the EP 2 429 339 B1 shows a generic prior art device. With this arrangement for locking and ejecting a movable furniture part, the synchronization is reached in that a rotary element in the form of a gear wheel is arranged at an end of a synchronizing rod which rotary element meshes with a gear rack attached to the ejection device. It is disadvantageous in this case that the rotary element has to be arranged in a complicated manner in a holding jack when attaching the synchronizing rod. In doing so, tooth errors may occur between the teeth of the rotary element and the gear rack, whereby the entire synchronizing rod could already be mounted in an undesired oblique manner. Moreover, the gear rack has to be formed quite elaborate with a spring element in order to allow an adaptation of the length of the synchronizing rod to different distances between the ejection devices on both sides. This elaborate telescope configuration of the gear rack is necessary in order to allow in the first place the insertion and subsequent holding of the synchronizing rod on both ejection devices.

Another generic prior art device is disclosed in the not pre-published Austrian Patent Application with the Application number A 785/2013 (AT 514 865 A1). According to this document, a gear wheel arranged on the end of a gear rack meshes with a coupling element (transmission element) also forming the sliding guide track. Also in this case, there are the same disadvantages during insertion and connection as in the previous document.

SUMMARY OF THE INVENTION

Therefore, the object of the present invention is to provide an improved drive device compared to the state of the art. In particular the synchronizing operation should take place as easy and uncomplicated as possible.

Accordingly, in an active synchronizing mode during the synchronizing operation, a movement transmission takes place from the first ejection device via the first synchronizing element, the synchronizing rod, and the second synchronizing element to the second ejection device. In an inactive synchronizing mode, the synchronizing rod is removed and the synchronizing elements each remain in contact with one of the ejection devices. In other words, the synchronizing elements are therefore not mounted together with the synchronizing rod anymore and are not again removed, but the synchronizing elements remain associated to the respective ejection device. Hence, each synchronizing element always remains in an appropriate constant contact with the ejection device, whereby no undesired skewed assembling can occur, for example with a tooth error. Again expressed differently, also in the inactive synchronizing mode, the synchronizing elements always partly participate with the movements of the ejection device. Because of the missing synchronizing rods, however, no transmission of this movement takes place between the synchronizing elements.

In the course of a relative movement between the synchronizing elements and—preferably all components of—the ejection device, a motion transformation of a rotary movement into a translational movement can take place. Preferably, the motion transformation is effected from a rotary movement about a first rotary axis into a rotary movement about a differently oriented rotary axis (these axes are preferably perpendicular to each other). Accordingly, it is particularly preferred that the ejection devices each comprise a housing and a transmission element supported movably, preferably rotationally, on the housing. The synchronizing elements each are movably coupled with one of the transmission elements. In this case, in principle, the motion coupling can be effected for example via friction wheels. Preferably, however, the motion coupling is reached by a form fit. Accordingly, preferably each synchronizing element comprises a gear wheel and each transmission element comprises a section in the shape of a gear rack, and the gear wheels each mesh with one of the sections in the shape of a gear rack. It shall not be excluded that the synchronizing elements are in the shape of a gear rack, and are movably translational if applicable, while the transmission elements are formed as gear wheels.

In general, the ejection device can be formed arbitrarily, as long as an active ejection of the movable furniture part from a closed position in an opening direction is possible. Particularly preferable, each ejection device comprises a force-actuated ejection element for ejecting the movable furniture part from a closed position into an open position, and a locking device for locking the ejection element in a locking position, and the locking device can be unlocked by over-pressing the movable furniture part into an over-pressing position lying behind the closing position. In this case, it is particularly preferred that the locking device comprises a locking peg and a, preferably heart curve-shaped, sliding guide track formed in the housing. Additionally, each transmission element can form a part of each sliding guide track, preferably a latch recess of the heart curve-shaped sliding guide track. Thus, only a small part of the movement of the ejection device is synchronized by the synchronizing device, namely the part in which the transmission element is movable because of a triggering motion shortly after the over-pressing. In other words, only a section of the movements of the ejection devices can by synchronized—preferably only a first section of an opening movement of the movable furniture part which immediately follows after the over-pressing position, and reference is made content-wise to the not pre-published, Austrian Patent Application A 785/2013.

In order to enable an unproblematic holding of the synchronizing elements on the ejections devices, preferably each synchronizing element is supported—preferably in a rotating configuration and preferably axially fixed—on the housing of the ejection device via a bearing element. By the rotating support and by the axial fixation, the synchronizing element can take part in each movement of the transmission device without an occurrence of a false position between these parts.

For the good movement transmission in the active synchronizing mode, preferably the synchronizing rod comprises on both end sections a non-circular cross section, and each synchronizing element comprises a receiving area which at least section-wise matches with the outer contour of the end sections of the synchronizing rod. With this non-circular cross section, a form fit is reached between the involved parts. For example, this non-circular cross section can be triangular. It is also possible that this end section is mostly formed circular and only comprises a flattened area. Particularly preferred, however, this non-circular cross section is fquadratic, which has the advantage of a simple production. In addition, a distortion of the entire synchronizing rod about 90° is virtually impossible. Until now, tooth errors were already possible by a small distortion. As additionally the gear wheel and the synchronizing element respectively are pre-mounted to the ejection device, such errors are now precluded.

In an operating state, the synchronizing element is permanently connected with the ejection device. Only the synchronizing rod is connected to or inserted into the synchronizing element in a nondestructive detachable configuration.

In principle, the synchronizing rod can be formed in one piece and can comprise corresponding end sections. For example, the synchronizing rod can be formed as a square shaft along the whole length. Preferably, however, the synchronizing rod comprises a rod-shaped base part—preferably formed as a hollow profile with the same inner diameter along the entire length—and two plug-in-parts are mountable to the ends of the base part and form the end sections A particular advantage compared to previous realizations of the synchronizing rod is that that the synchronizing rod is formed unchangeable in length. This means the synchronizing rod does not have to be formed telescopically. Rather, a certain tolerance in distance is reached in that the receiving area of the synchronizing element is formed elongated. Moreover, only a momentum transmission is effected via this synchronizing rod.

In addition, an item of furniture can comprise a furniture carcass, a furniture part movably supported on the furniture carcass, preferably via an extension guide, and a drive device according to the invention. In this case, the drive device can be arranged on the furniture carcass or can be fixed via a carcass rail. Preferably, the drive device is associated with the movable furniture part, and particularly preferably it is mounted to the underside of the movable furniture part.

BRIEF DESCRIPTION OF THE DRAWINGS

Further details and advantages of the present invention are described more fully hereinafter by means of the specific description with reference to the embodiments illustrated in the drawings, in which.

DETAILED DESCRIPTION OF THE INVENTION

Figure 1:
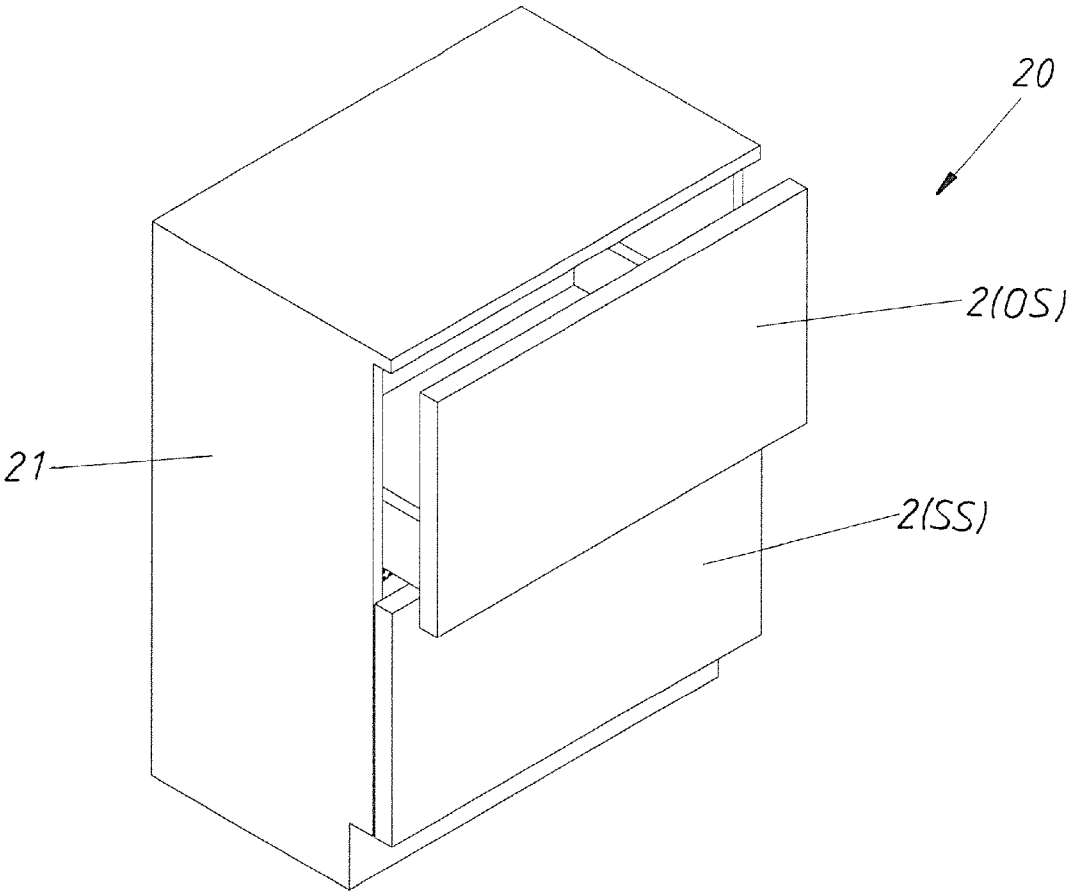
FIG. 1 is a perspective view of the item of furniture.

FIG. 1 shows an item of furniture 20 with a furniture carcass 21 and two furniture parts 2 movably supported in the furniture carcass 21. These two movable furniture parts 2 are built as drawers, wherein the upper drawer is in an open position OS and the lower drawer is in a closed position SS.

Figure 2:
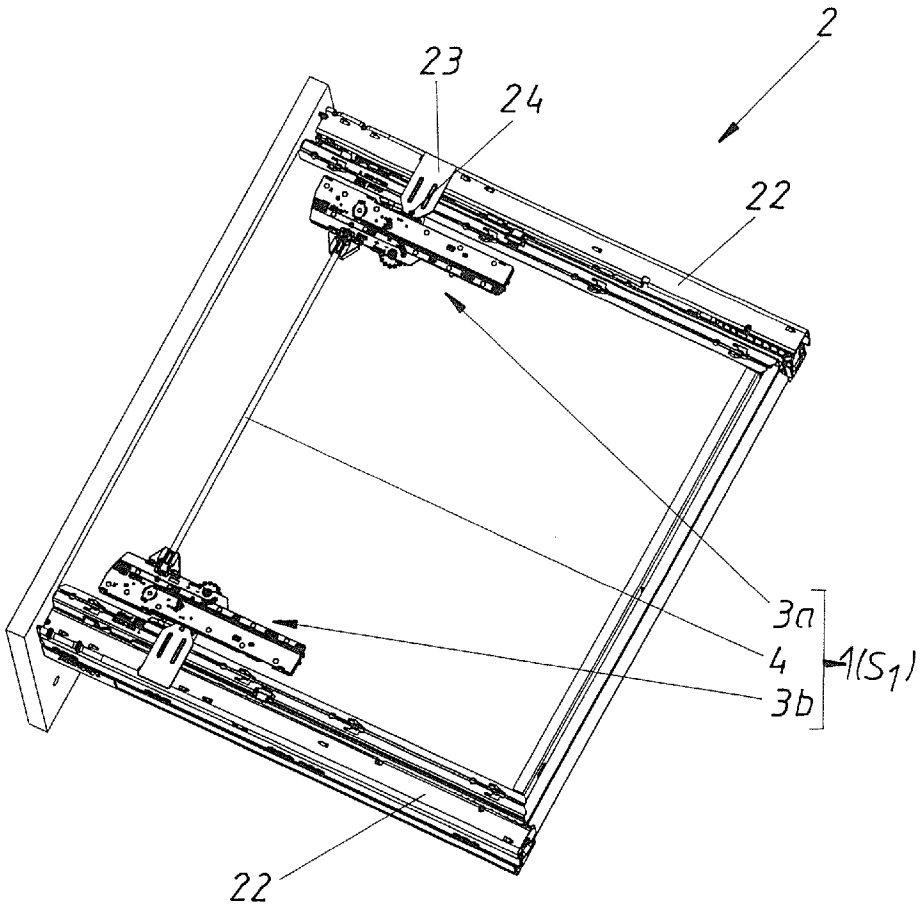
FIG. 2 is a view from below of the movable furniture part in the active synchronizing mode.

As can be recognized in FIG. 2, such a movable furniture part 2 is connected to the (here not shown) furniture carcass 21 via an extension guide 22. On the underside of the movable furniture part 2, especially on the drawer bottom, respective ejection devices 3*a* and 3*b* are arranged on both sides. Each of these ejection devices 3*a* and 3*b* is at least section-wise coupled with an entrainment member 24. These entrainment members 24, in turn, are fixed via holding plates 23 to the extension guides 22, especially to their carcass rails 25. Upon ejection, the movable furniture part 2, thus, repels from the entrainment members 24 (which are fixed to the furniture carcass) via the two ejection devices 3*a* and 3*b* and moves the movable furniture part 2 in opening direction. In order to prevent an oblique placement of the drawer, especially in the case of broad drawers (starting from about 60 cm), a synchronizing device 4 is provided. This synchronizing device 4 together with the two lockable ejection devices 3*a* and 3*b* forms the drive device 1. In this case, the drive device 1 is in an active synchronizing mode $S_1$.

Figure 3:
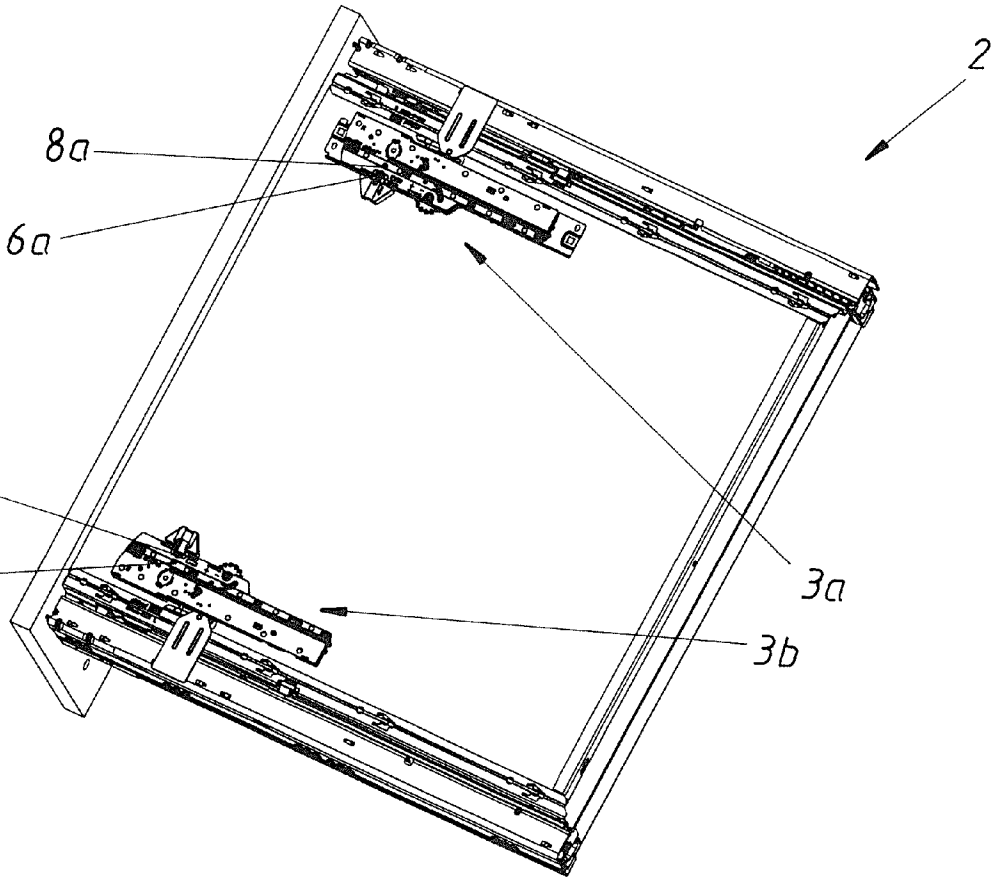
FIG. 3 is a view from below of the movable furniture part in the inactive synchronizing mode.

In contrast, the drive device 1 in FIG. 3 is in an inactive synchronizing mode $S_0$, in which the synchronizing rod 5 of the synchronizing device is removed. However, also in this inactive synchronizing mode $S_0$, the two synchronizing elements 6*a* and 6*b* each remain in direct contact with one of the ejection devices 3*a* and 3*b* and especially with the transmission elements 8*a* and 8*b*, respectively. Therefore, the synchronizing elements 6*a* and 6*b* are—in contrast to the non-generic prior art—always associated with the ejection devices 3*a* and 3*b* and are not removed together with the removal of the synchronizing rods 5. The synchronizing elements 6*a* and 6*b* are, thus, premounted to the ejection devices 3*a* and 3*b* and are connected with ejection devices 3*a* and 3*b* in a non-detachable configuration in the operating state.

Figure 4:
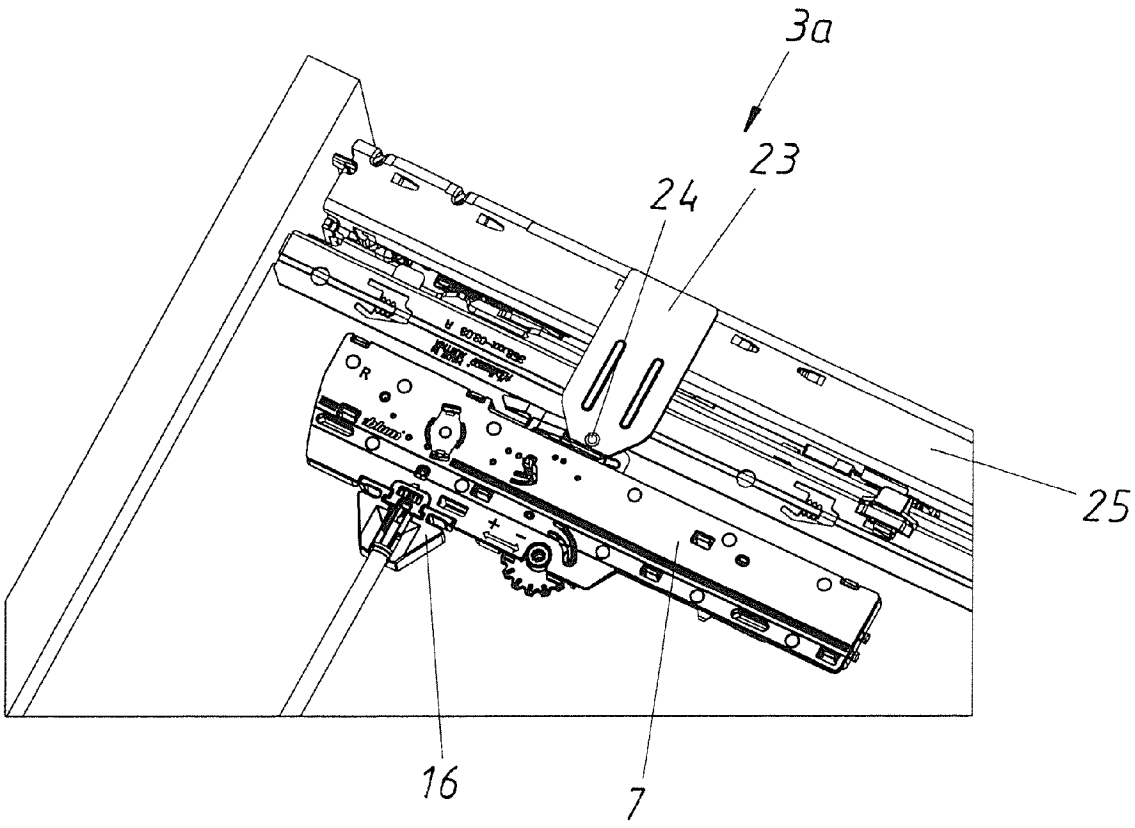
FIGS. 4 and 5 show details of FIG. 2.

FIG. 4 shows again in detail especially the carcass rail 25 and the entrainment member 24 fixed thereon via the holding plate 23. In the area of the extension guide 22, a retracting device for a, preferably damped, retraction of the movable furniture part 2 from an open position OS into the closed position SS is also provided. The ejection device 3*a*—as a separate and autonomous construction unit, respectively—comprises a housing 7 on which also the bearing element 16 for the synchronizing device 4 is arranged. This bearing element 16 can be formed in one piece with the housing 7.

Figure 5:
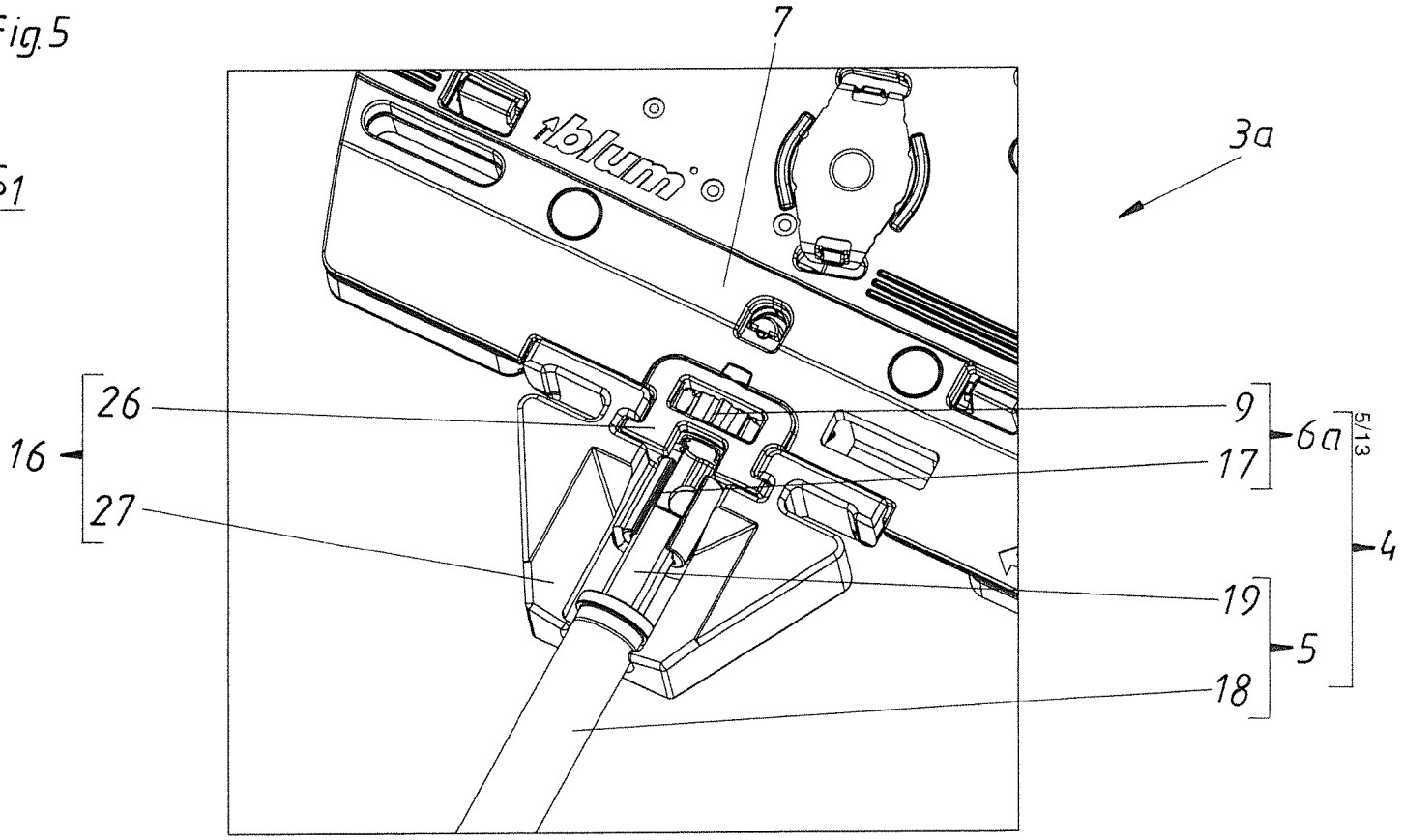

As recognizable in FIG. 5, the bearing element 16 is formed separate from the housing 7. Preferably the bearing element 16 itself comprises two construction parts, namely the rotary bearing part 26 and the support part 27. The synchronizing element 6*a* is supported or held on the rotary bearing part 26 in a rotating and axially stationary configuration, whereas the synchronizing rod 5 is mainly supported and guided on the support part 27. In this FIG. 5, it is can also be seen that the synchronizing element 6*a* on the one hand comprises the gear wheel 9 and on the other hand comprises the receiving area (receiving portion) 17. The synchronizing element 6*a* is preferably formed separate from all components (actuating elements) of the ejection device 3*a*. Preferably, this synchronizing element 6*a* is formed in one piece. In contrast, the synchronizing rod 5 is preferably made in two pieces or in three pieces and comprises on both end sections E plug in parts 19 which can be inserted into the base part 18. The synchronizing rod 5 as well as the two synchronizing elements 6*a* and 6*b* together form the synchronizing device 4. As already well recognizable in this FIG. 5, the synchronizing rod 5 has a non-circular cross section on both end sections E. Corresponding thereto, each synchronizing element 6*a* and 6*b* has a receiving portion 17 which at least section-wise corresponds to the outer contour of the end sections E of the synchronizing rod 5.

Figure 6:
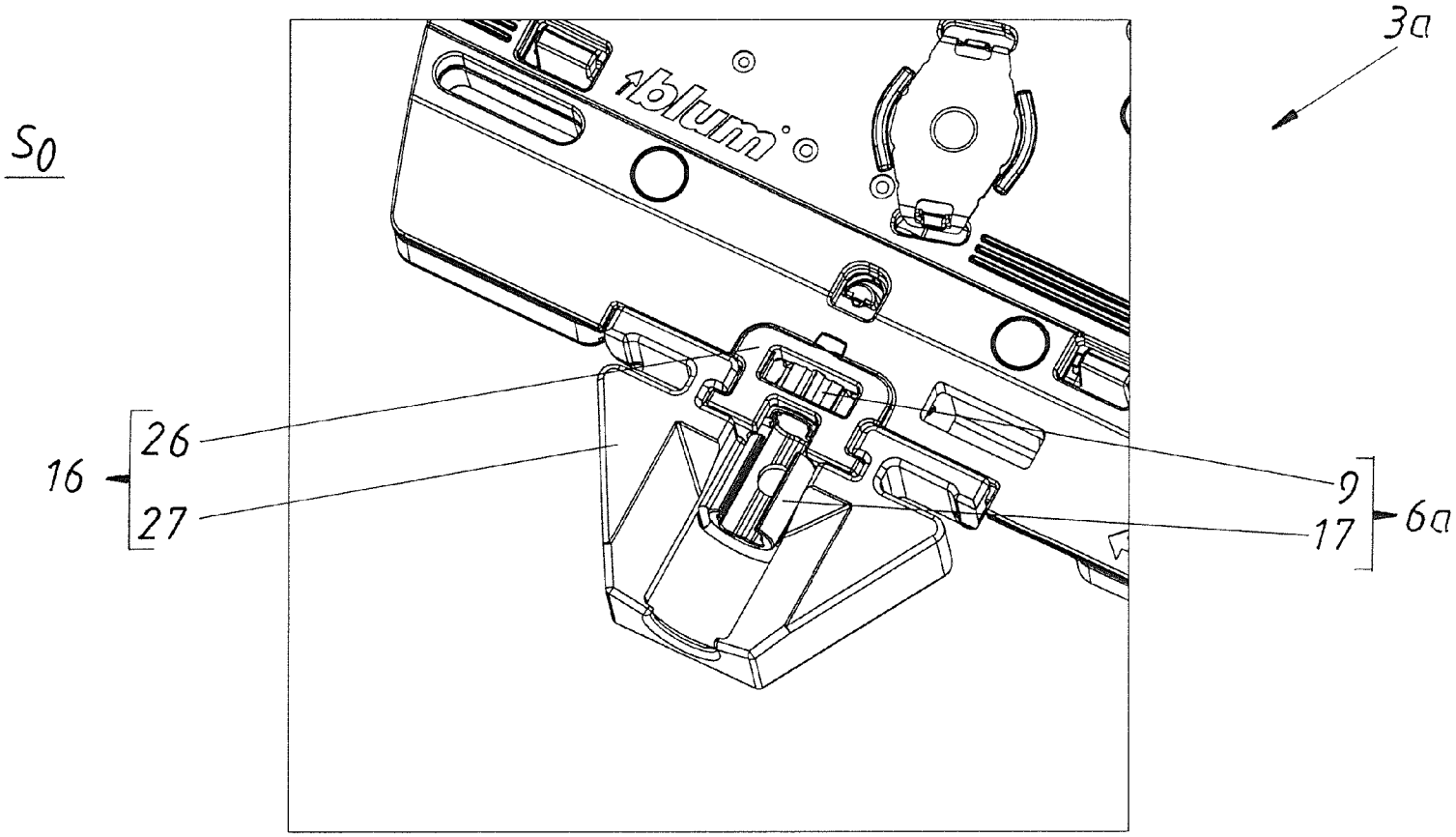
FIG. 6 shows a detail of FIG. 3.

In FIG. 6 the synchronizing rod 5 is removed whereby the drive device 1 is in an inactive synchronizing mode $S_0$. As well recognizable in FIG. 6, the synchronizing element 6*a* remains on the ejection device 3 in the inactive synchronizing mode $S_0$ too.

Figure 7:
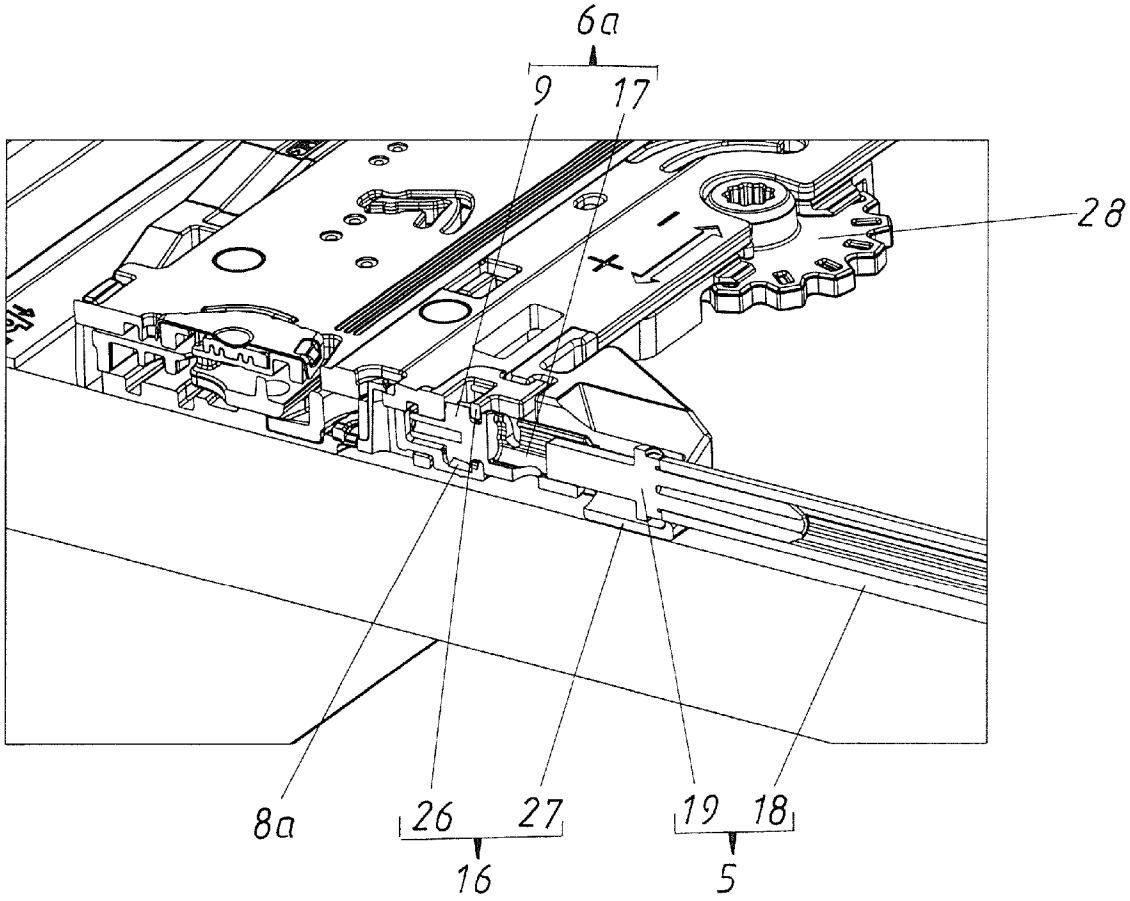
FIG. 7 shows a partial cross section through the area of the synchronizing rod and of a synchronizing element.

FIG. 7 shows a cross section through the drive device 1 in the region of the synchronizing rod 5. As well visible in this FIG. 7, the base part 18 is supported on the support part 27. The synchronizing element 6*a* is rotationally supported in the rotary bearing part 26 and meshes with the transmission element 8*a*. Further, a depth adjustment wheel 28 is illustrated in this FIG. 7.

Figure 8:
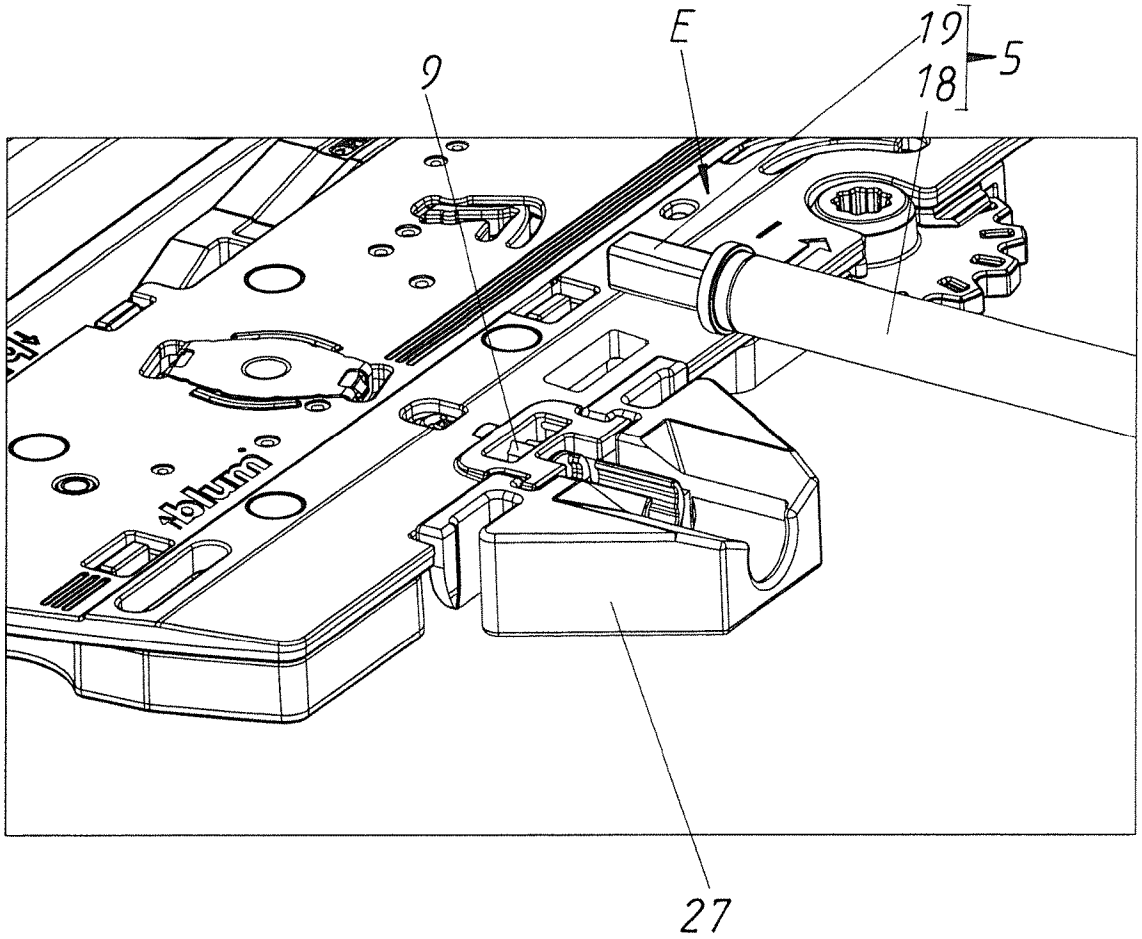
FIG. 8 shows the synchronizing rod before the insertion into the bearing element.

FIG. 8 shows the synchronizing rod 5 with the end section E before the insertion into the receiving portion 17 of the synchronizing element 6*a*.

Figure 9:
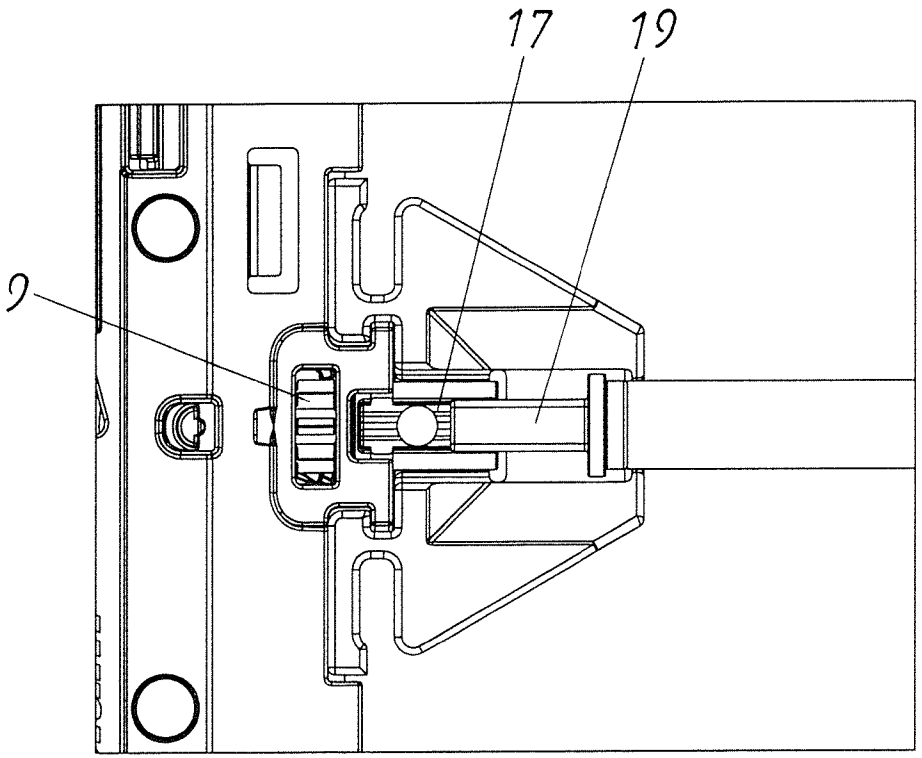
FIGS. 9 and 10 are top views onto the bearing area of the synchronizing rod with the end section which projects differently deep into the bearing element.
Figure 10:
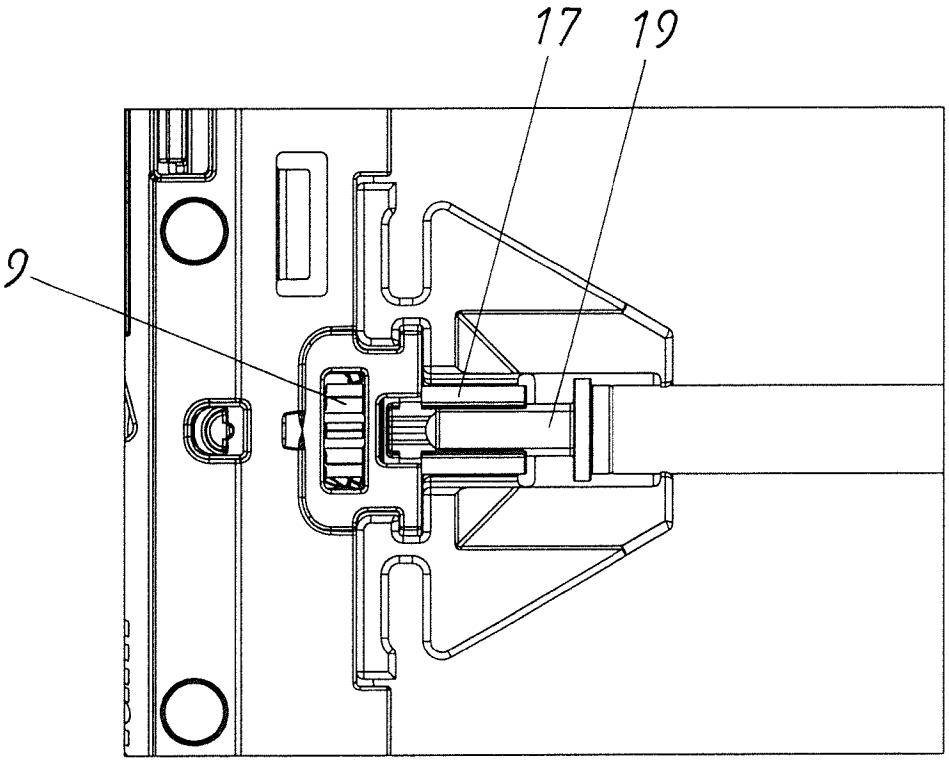

In the comparison between the FIGS. 9 and 10 it is recognizable that the synchronizing rod 5 and its plug in part 19 are projecting differently deep into the receiving portion 17 due to the length of the receiving portion 17. This enables an uncomplicated synchronization and an uncomplicated switching of the drive device 1 into the active synchronizing mode $S_1$, respectively, even if the ejection devices 3*a* and 3*b* should be differently distanced (spaced apart) from each other. This is especially the case when differently broad drawer bottom or ground-level compartments are used. This broadness of the bottom, in turn, is dependent upon the thickness of the side wall of the furniture carcass. If, for instance, in the case of constant external dimensions of the furniture carcass, thinner furniture carcass side walls are used (16 mm instead of 19 mm), then also the extension guides 22 mounted to the furniture carcass side walls and also the drawer side walls are farther distanced from each other by 6 mm, which in turn is compensated for by a broader drawer bottom.

Figure 11:
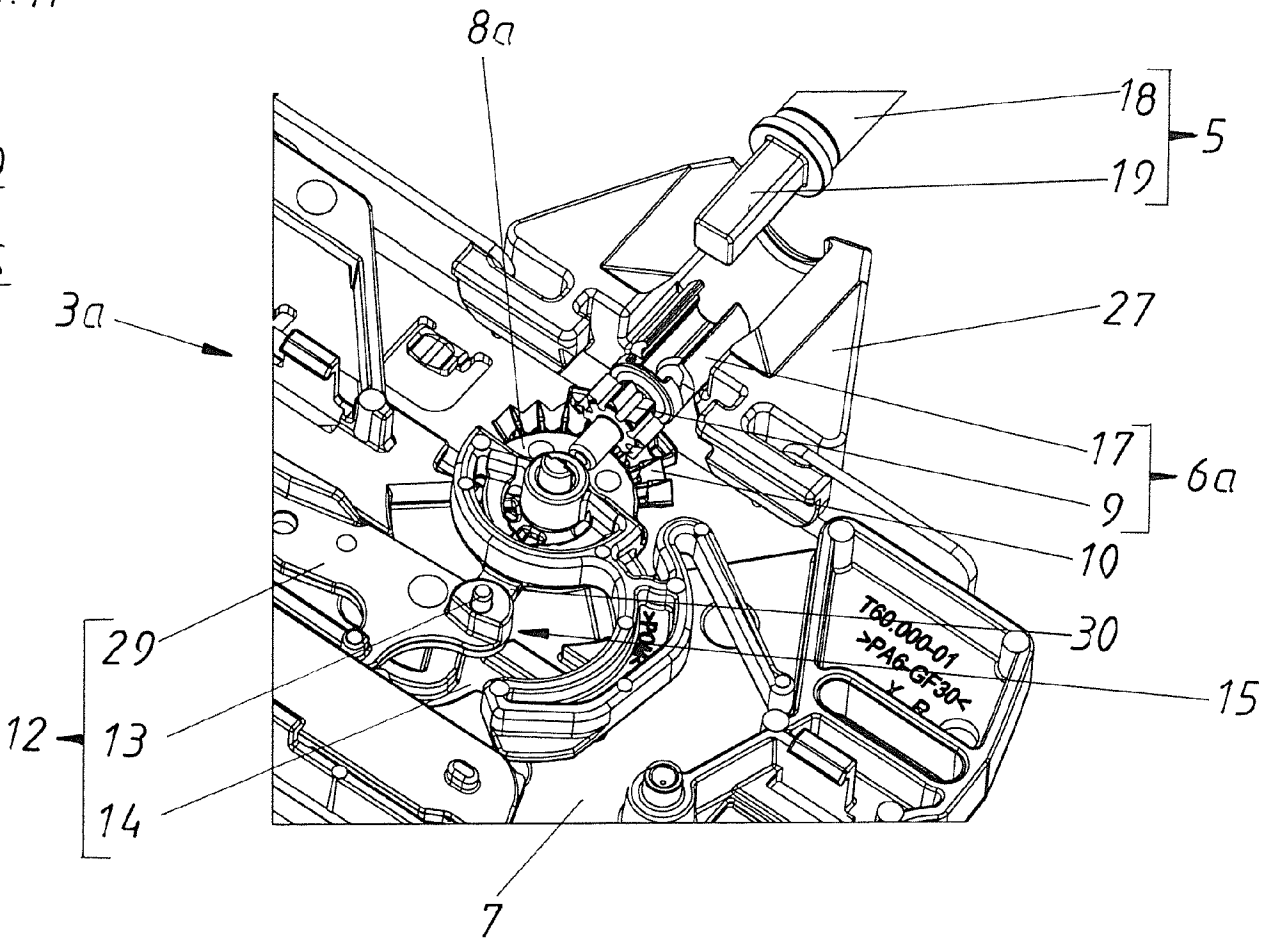
FIGS. 11 to 13 show details of the ejection device with different positions of the synchronizing device.
Figure 12:
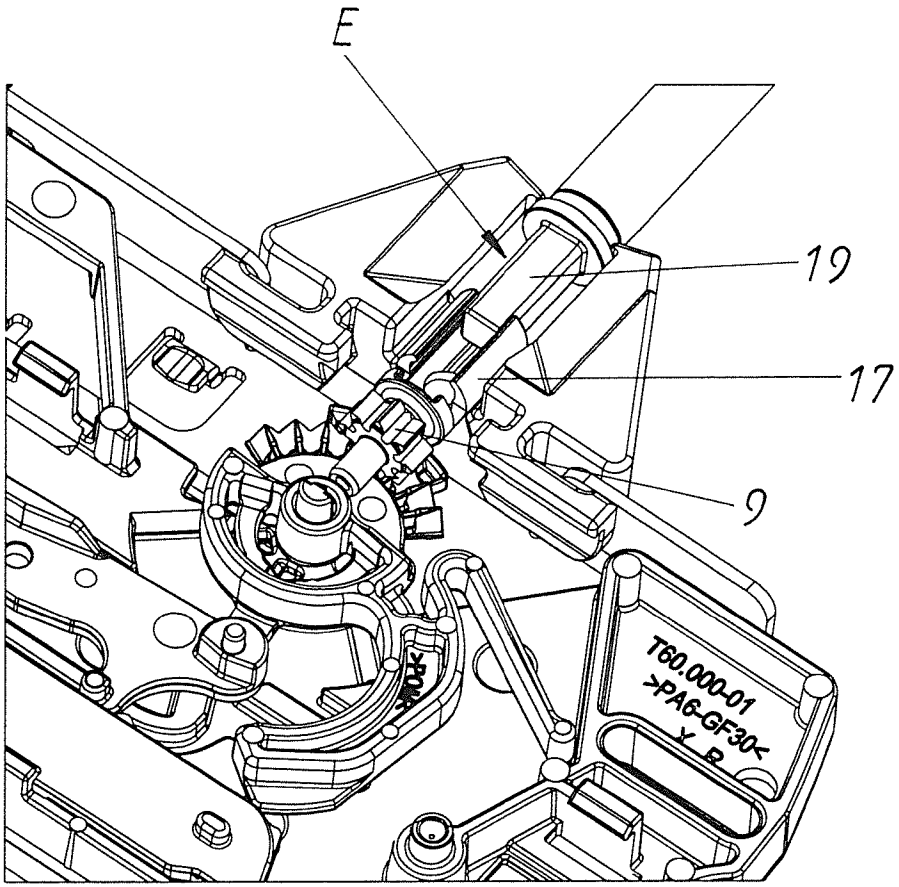
Figure 13:
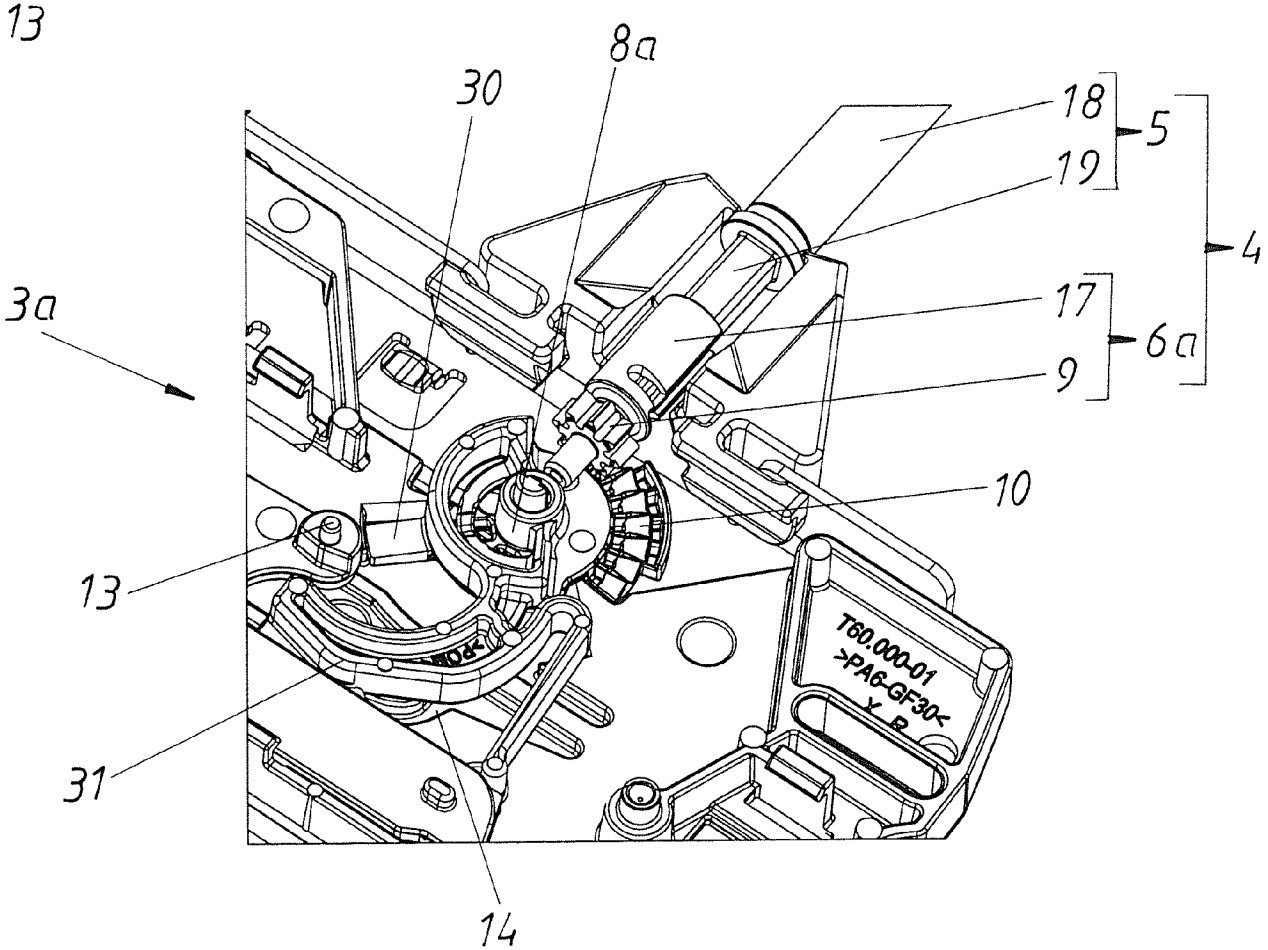

In the FIGS. 11 to 13, details of the ejection device 3*a* are visible. The locking lever 29 and the locking peg 13 arranged thereon are substantially in the region of the ejection device 3*a*. The locking peg 13 engages with or is guided in the heart curve-shaped sliding guide track 14 formed in the housing 7. These components together form the locking device 12 for the lockable ejection device 3*a* and 3*b*, respectively. The ejection element is not illustrated in these FIGS. 11 to 13. The ejection element is formed as a slider movably supported in the housing. This slider is force-actuated by an ejection spring. Additional components are provided in order to enable a coupling of this movement of the ejection slider with the entrainment member 24 (catch hook and coupling element). According to FIG. 11, the locking peg 13 is located in the latch recess 15 which can be recognized only rudimentarily. This latch recess 15 is also formed by the extension 30. This extension 30 is part of the transmission element 8*a*. This transmission element 8*a* is rotationally supported on the housing 7 about a, preferably vertical, rotary axis. The gear rack shaped section 10 is also formed on this transmission element 8*a*, which gear rack shaped section 10 meshes with the gear wheel 9 of the synchronizing element 6*a*. Because of the position of the locking peg 13, the ejection device 3*a* is in the locking position VS. The drive device 1 shown in FIG. 11 is in the inactive synchronizing mode $S_0$ because the synchronizing rod 5 is not yet inserted.

In contrast, the drive device 1 according to FIG. 12 is in the active synchronizing mode $S_1$ because the synchronizing rod 5 is inserted into the receiving section 17 via the plug in part 19. The ejection device 3*a*, however, is still in the locking position VS.

Compared with this, an over-pressing movement has already been carried out according to FIG. 13. Thereby, the movable furniture part 2 reaches the over-pressing position (not illustrated) and the locking peg 13 leaves the latch recess 15. Upon the subsequent movement into ejection direction, the extension 30 is entrained by this locking peg 13, whereby the transmission element 8*a* is turned in clockwise direction. With this turning of the transmission element 8*a*, a movement of the gear wheel 9 is triggered via the gear rack shaped section 10. Hence, the synchronizing rod 5 is moved in counterclockwise direction. Compared to FIG. 12, the synchronizing rod 5 has been almost turned about 270°. In the course of the rotation, the form fit remains between the receiving section 17 and the plug in part 19 especially due to the fact that the synchronizing rod 5 is held axially and radially fixed in the bearing element 16. Upon a further ejection operation, no more synchronization takes place. Rather, only the unlocking movement of the locking pin 13 out of the latch recess 15 is synchronized by this synchronizing device 4. The transmission element 8*a* is, of course, moved back to the position according to FIG. 12 via the lever 31 when moving the locking peg 13 into the locking position VS.

Depending on which side the unlocking is effected first in the case of an unequal triggering, this movement is then correspondingly transmitted to the other side so that on this other side the extension 30 is as well moved because of the synchronization. Thereby, the locking peg 13 can no longer be held in the latch recess 15 and, thus, the ejection operation is effected on both sides at the same time with simultaneously or synchronously relaxing ejection force storage members (not illustrated).

In general, it should be noticed that, of course, the corresponding components on the respective other side are formed mirror-symmetrically. Thus, if in the description is made reference only to a part on one side, this applies analogously also to the other side.

LIST OF REFERENCE SIGNS

1 drive device
2 movable furniture part
3*a* first lockable ejection device
3*b* second lockable ejection device
4 synchronizing device
5 synchronizing rod
6*a, b* synchronizing elements
7 housing
8*a, b* transmission elements
9 gear wheel
10 gear rack shaped section
12 locking device
13 locking peg
14 sliding guide track
15 latch recess
16 bearing element
17 receiving section
18 base part
19*a, b* plug in parts
20 item of furniture
21 furniture carcass
22 extension guide
23 holding plate
24 entrainment member
25 carcass rail
26 rotary bearing part
27 support part
28 depth adjustment wheel
29 locking lever
30 extension
31 lever
$S_1$ active synchronizing mode
$S_0$ inactive synchronizing mode
SS closing position
OS open position
VS locking position
E end sections

The invention claimed is:

1. A drive device for a movable furniture part, comprising:

a first lockable ejection device and a second lockable ejection device, each of the first and second ejection devices comprising a housing;

a synchronizing device for synchronizing the first and second ejection devices; and a first bearing element fixed to the housing of the first ejection device, and a second bearing element fixed to the housing of the second ejection device, each of the first bearing element and the second bearing element comprising a rotary bearing part;

wherein the synchronizing device includes:

a synchronizing rod;

a first synchronizing element; and a second synchronizing element, each of the first synchronizing element and the second synchronizing element being rotatably supported by a respective one of the first bearing element and the second bearing element such that an axial side of each of the first synchronizing element and the second synchronizing element closest to the synchronizing rod contacts the rotary bearing part of a respective one of the first bearing element and the second bearing element so as to be non-detachably fixed to a respective one of the first ejection device and the second ejection device, being detachably connected to the synchronizing rod, and being configured such that a relative movement takes place between the first and second synchronizing elements and the first and second ejection devices during a synchronizing operation; and wherein the first and second ejection devices and the synchronizing device are configured such that:

in an active synchronizing mode during the synchronizing operation, a movement transmission takes place from the first ejection device to the second ejection device via the first synchronizing element, the synchronizing rod, and the second synchronizing element; and in an inactive synchronizing mode, the synchronizing rod is detached from each of the first and second synchronizing elements, and each of the first and second synchronizing elements remains fixed to and in contact with the respective one of the first and second ejection devices.

2. The drive device according to claim 1, wherein each of the first and second ejection devices further comprises a transmission element supported movably on the housing, each of the first and second synchronizing elements being movably coupled with a respective one of the transmission elements.

3. The drive device according to claim 2, wherein each of the first and second synchronizing elements comprises a gear wheel, and each of the transmission elements comprises a section in the shape of a gear rack, each of the gear wheels meshing with a respective one of the sections in the shape of a gear rack.

4. The drive device according to claim 2, wherein each of the first and second ejection devices comprises a force-actuated ejection element for ejecting the movable furniture part from a closed position into an open position, and a locking device for locking the ejection element in a locking position, the locking device configured to be unlocked by over-pressing the movable furniture part into an over-pressing position lying behind the closing position.

5. The drive device according to claim 4, wherein the locking device comprises a locking peg and a sliding guide track formed in the housing.

6. The drive device according to claim 5, wherein each of the transmission elements forms a part of each sliding guide track.

7. The drive device according to claim 1, wherein each end section of the synchronizing rod has a non-circular cross section, and each of the first and second synchronizing elements comprises a receiving portion which at least section-wise matches with an outer contour of a respective end section of the synchronizing rod.

8. The drive device according to claim 7, wherein the synchronizing rod comprises a rod-shaped base part and two plug in parts mountable to ends of the base part and forming the end sections.

9. The drive device according to claim 1, wherein the synchronizing rod has a constant and unchangeable length.

10. The drive device according to claim 1, wherein only a part section of movements of the first and second ejection devices are synchronizable by the synchronizing device.

11. An item of furniture comprising:

a furniture carcass, a furniture part movably supported on the furniture carcass, and the drive device according to claim 1.

12. The drive device according to claim 2, wherein the transmission element is supported rotatably on the housing.

13. The drive device according to claim 5, wherein the sliding guide track formed in the housing is heart curve-shaped.

14. The drive device according to claim 6, wherein each transmission element forms a latch recess of each sliding guide track.

15. The drive device according to claim 1, wherein each of the first and second synchronizing elements is supported in a rotating configuration and axially fixed on the housing via the bearing element.

16. The drive device according to claim 8, wherein the rod-shaped base part has a hollow profile with a uniform inner diameter along an entire length thereof.

17. The drive device according to claim 10, wherein the part section is a first section of an opening movement of the movable furniture part which section directly follows to an over-pressing position.

18. The item of furniture of claim 11, wherein the furniture part is movably supported on the furniture carcass via an extension guide.

19. A drive device for a movable furniture part, comprising:

a first lockable ejection device and a second lockable ejection device, each of the first and second ejection devices comprising a housing;

a first bearing element fixed to the housing of the first ejection device, and a second bearing element fixed to the housing of the second ejection device, each of the first bearing element and the second bearing element comprising a rotary bearing part; and a synchronizing device for synchronizing the first and second ejection devices, the synchronizing device including:

a synchronizing rod;

a first synchronizing element having a gear wheel; and a second synchronizing element having a gear wheel, each of the first synchronizing element and the second synchronizing element being arranged such that a respective gear wheel is located within an opening of the rotary bearing part of a respective one of the first bearing element and the second bearing element so as to be surrounded by the rotary bearing part so that each of the first synchronizing element and the second synchronizing element is thereby non-detachably fixed to a respective one of the first ejection device and the second ejection device, being detachably connected to the synchronizing rod, and being configured such that a relative movement takes place between the first and second synchronizing elements and the first and second ejection devices during a synchronizing operation;

wherein the first and second ejection devices and the synchronizing device are configured such that:

in an active synchronizing mode during the synchronizing operation, a movement transmission takes place from the first ejection device to the second ejection device via the first synchronizing element, the synchronizing rod, and the second synchronizing element; and in an inactive synchronizing mode, the synchronizing rod is detached from each of the first and second synchronizing elements, and each of the first and second synchronizing elements remains fixed to and in contact with the respective one of the first and second ejection devices.

20. The drive device according to claim 19, wherein the gear wheel of each of the first synchronizing element and the second synchronizing element is rotatable about an axis parallel to the synchronizing rod, meshes with a transmission element of a respective one of the first ejection device and the second ejection device, and is axially fixed relative to the rotary bearing part.

* * * * *